US005402889A

United States Patent [19]

Hermann et al.

[11] Patent Number: 5,402,889

[45] Date of Patent: Apr. 4, 1995

[54] FOLDING BOX FOR PACKAGING ELONGATED ARTICLES

[75] Inventors: Manfred Hermann, Korb; Eberhard Krieger, Weinstadt; Guenter Loew, Waiblingen, all of Germany

[73] Assignee: Robert Bosch GmbH, Stuttgart, Germany

[21] Appl. No.: 201,957

[22] Filed: Feb. 25, 1994

[30] Foreign Application Priority Data

Mar. 20, 1993 [DE] Germany ..... 43 09 036.2

[51] Int. Cl.[6] ..... B65D 85/20; B65D 85/42; B65D 1/09; B65D 25/10

[52] U.S. Cl. ..... 206/443; 206/485; 206/528; 229/120.18

[58] Field of Search ..... 206/528, 443, 446, 485; 229/120.18, 120.21, 148, 102, 120.38

[56] References Cited

U.S. PATENT DOCUMENTS

| | | | |
|---|---|---|---|
| 3,047,135 | 7/1962 | Miller | 229/120.38 X |
| 3,115,247 | 12/1963 | Hauser | 206/528 |
| 3,921,895 | 11/1975 | Ziche | 206/528 X |
| 4,186,835 | 2/1980 | Hofer | 206/443 |

FOREIGN PATENT DOCUMENTS

| | | | |
|---|---|---|---|
| 2453309 | 5/1976 | Germany | 206/485 |
| 457360 | 5/1950 | Italy | 206/485 |
| 267543 | 6/1950 | Switzerland | 206/485 |
| 309373 | 11/1955 | Switzerland | 229/148 |
| 1468888 | 3/1977 | United Kingdom | 206/485 |

*Primary Examiner*—Bryon P. Gehman
*Attorney, Agent, or Firm*—Edwin E. Greigg; Ronald E. Greigg

[57] ABSTRACT

A folding box for packaging breakable articles such as ampules, miniature bottles, vials, or the like, having an insert to hold the articles. The insert is secured to a side wall of the folding box by base strips. The insert has two backdrop walls with openings and a strut, which connects the backdrop walls to one another. A compartment is embodied between the strut and the neighboring side wall to receive a package insert.

16 Claims, 2 Drawing Sheets

FOLDING BOX FOR PACKAGING ELONGATED ARTICLES

RELATED PATENT APPLICATION

This application is related to U.S. patent application Ser. No. 08/167,106 filed Dec. 15, 1993 and assigned to the same assignee.

BACKGROUND OF THE INVENTION

The invention relates to a folding box for packaging several elongated articles, such as ampules, miniature bottles, vials or the like as defined hereinafter. A folding box of this kind, known for example from German Offenlegungsschrift DE-OS 24 53 309, is folded from a blank, which also includes the insert. The part of the blank that forms the insert is connected to a narrow side wall of the folding box, via a fold line that extends between the two ends of the case. The folding into a box as well as the filling and closing can only be carried out by an apparatus especially arranged for that purpose. As a result of the embodiment and the placement of the insert, after being glued together at the packing material manufacturer, this known folding box cannot be laid flat again and then stored and shipped flat; nor can it then, in the packing operation, be erected, outfitted, and closed using a standard cartoning machine, as the majority of the folding boxes in use today are handled.

OBJECT AND SUMMARY OF THE INVENTION

The folding box according to the invention has the advantage that, at the folding box manufacturer, it can be folded from a single blank, glued and laid flat, then shipped in stacks to the packer and stored there as well as erected, outfitted with the articles to be packaged, and closed, all using a conventional high-capacity cartoning machine. Because of the separate manufacture of the folding boxes in the cardboard factory and the filling in a packing plant elsewhere, there is also the advantage that the problem of dust generated in the folding operation does not show up in the packing plant, which is especially important in the packaging of pharmaceuticals. Additionally in the new type of folding box, a separate compartment sized to hold a package insert with information on usage, for example a leaflet or a brochure, is disposed so that when the folding box is opened, the articles and the package insert are accessible and can be taken out separately without hindrance. In addition, the package insert falls right into the consumer's field of view upon opening the folding box; it is easy to take out and, after being looked at, is just as easily put back in the folding box with the remaining articles, where it cannot get lost.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
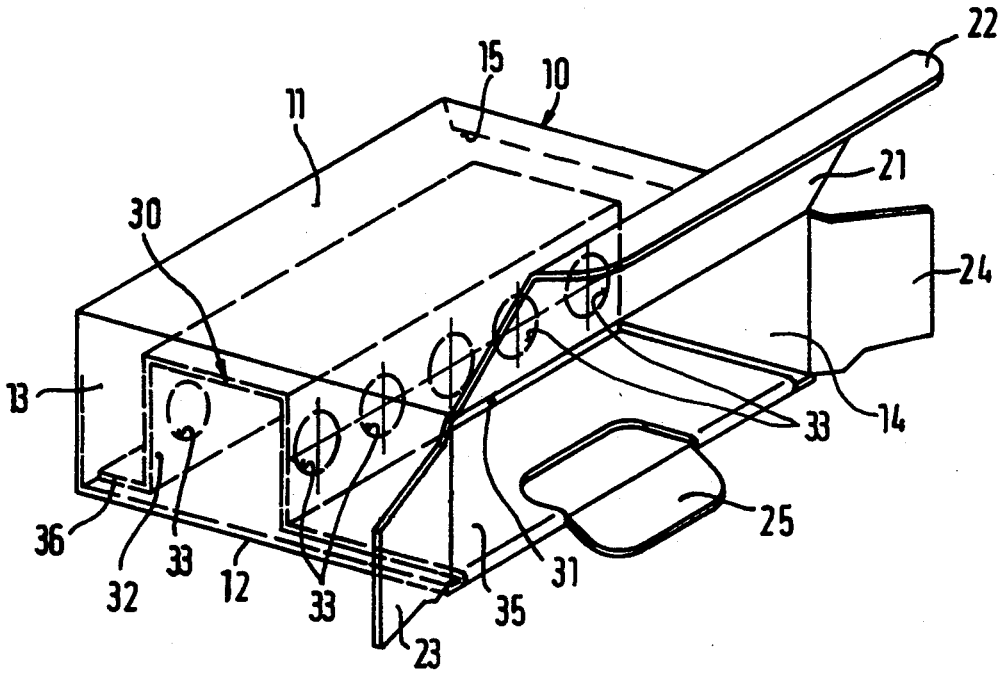
FIG. 1 shows a graphic representation of a folding box with its closing lid open.

The block-shaped folding box, comprising a stiff packing material, preferably cardboard, has a box-shaped body 10 with two parallel broad side walls 11, 12 and two parallel narrow end walls 13, 14; the one narrow end wall 14, having a hinged longitudinal gluing flap 15, is glued to the interior of the one broad side wall 11. The bottom face of the body 10 is tightly closed by means of closing flaps 16, 17, 18, 19 hinged to the side and end walls 11–14, folded over at the face end, and glued to one another. Conversely, the top face, which embodies the opening end of the box, is closed by two closing flaps 23, 24 at the narrow end walls 13, 14 and only a single, broad closing flap 21, which is hinged to the broad side wall 11 and with which an insertion tab 22 is connected via a folding line.

For the packaging of breakable articles such as ampules 1, miniature bottles, vials and the like, the above-described folding box, which is known up to this point, has an insert 30 in the form of a cavity wall or a frame to receive and carry the articles. This insert 30 is comprised of two backdrop walls 31, 32 which extend in the interior of the body 10 parallel to and at a set distance from its faces. The backdrop walls 31, 32, which have aligned openings 33 form fitted to receive the articles, are fastened on the one side with hinged base strips 35, 36, by being glued to the interior of the other broad side wall 12, and are connected to each other on the other side via a strut 38. The one base strip 35 advantageously adjoins the other broad side wall 12 in one piece via a fold line, so that the actual folding box as well as its insert 30 can be folded from a single blank. The insert 30, having the backdrop walls 31, 32, the base strips 35, 36, and the strut 38, has a length which is somewhat less than the width of the broad side wall 12 which carries it. The width of the base strips 35, 36 is selected so that the base strip 35 which is close to the opening end leaves a little bit of space or headroom at the top, which is larger than the space at the bottom that is determined by means of the other base strip 36. Furthermore, the width of both of the backdrop walls 31, 32 is smaller by a set measure, for example 5 to 10 mm, than the width of both narrow side walls 13, 14, so that the strut 38 that conjoins the backdrop walls 31, 32 extends at a certain distance from the one broad side wall 11; between this broad side wall 11 and the strut 38, a gap or a compartment 40 is embodied, into which a folded package insert 41 is inserted so that it can be taken out from the opening end.

Figure 2:
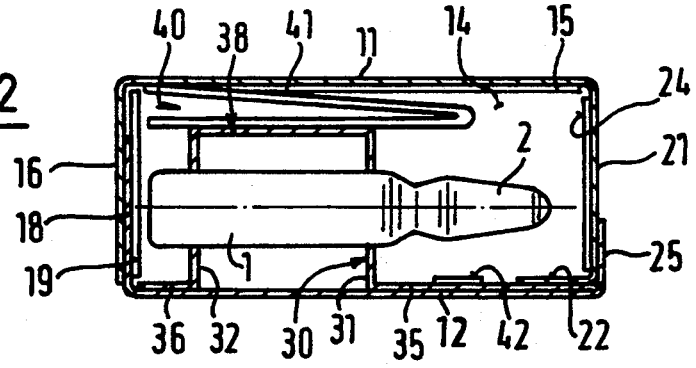
FIG. 2 shows a longitudinal section of the folding box according to FIG. 1.
Figure 3:
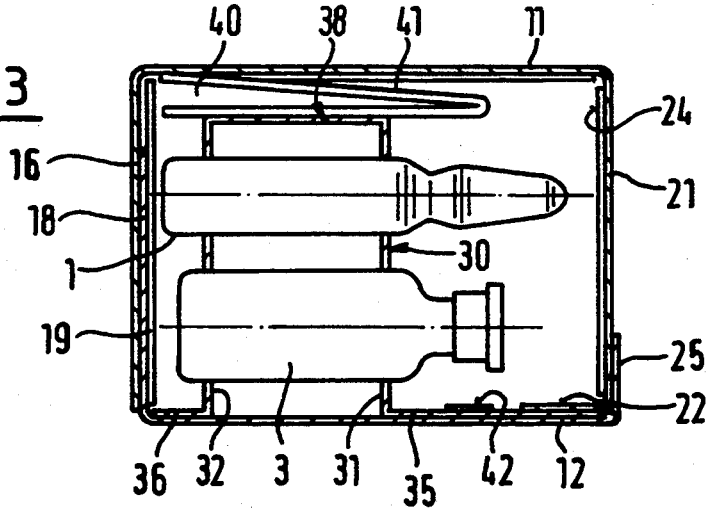
FIG. 3 shows a longitudinal section of a folding box that has been modified in comparison to FIG. 1.

The folding box is outfitted so that several articles like ampules 1 are inserted into the openings 33 of the backdrop walls 31, 32, with their tops, the tips 2, pointing toward the removal opening. The articles can be disposed in a single row next to one another (FIGS. 1 and 2). The backdrop walls 31, 32, however, can also have several, for example two, rows of openings to receive articles. Different articles, such as ampules 1 and vials 3, can also be packed in one folding box (FIG. 3). When several rows of openings are provided, they can be disposed on top of one another and also offset from each other. The cross section of the opening is fitted to the cross section of the articles to be packed so that they can be immovably held, with a set retention force. In FIG. 1, the cross section is shown as a circle;

it goes without saying that the openings can also be embodied as stamped-out holes with notches, teeth, or the like, or as hinged tongues cut free on three sides by stamping.

In addition, a tool, such as a file 42 or a pipette, that is associated with the ampules or vials is placed in the space at the top of the folding box, which is partitioned off by the backdrop wall 31 at the opening end.

To embody a tamper-evident closure, a cover flap 25 is folded over and glued to the closing flap 21, which covers the removal opening and whose connecting insertion tab 22 reaches into the interior of the folding box.

Figure 4:
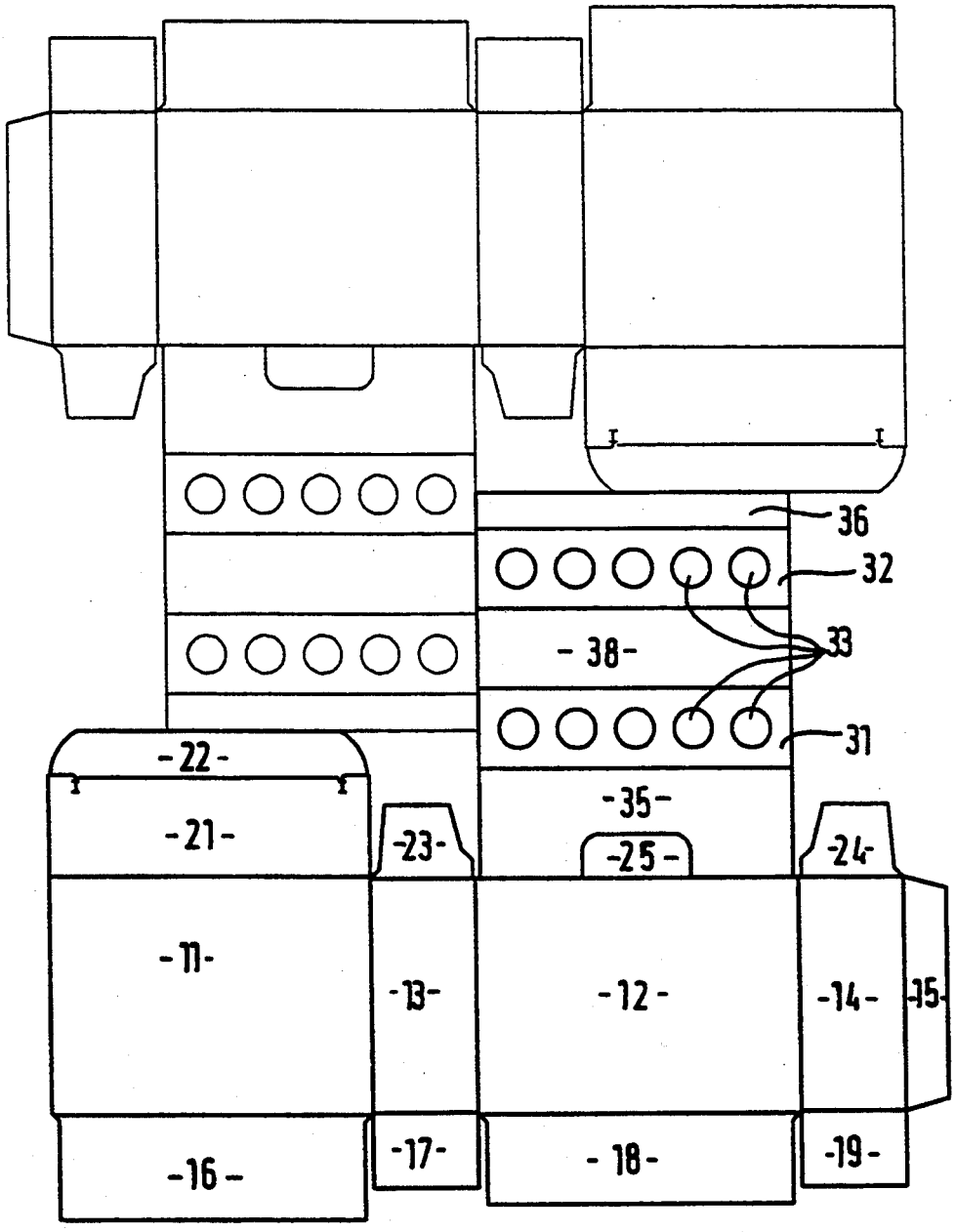
FIG. 4 shows a top view of a blank for the folding box according to FIGS. 1 and 2.

As is clearly shown in FIG. 4, the blank for the folding box, having the one-piece insert 30, can be stamped out of a sheet of cardboard without great waste if two blanks are arranged with their respective insert parts pointing away from one another in the direction of the sheet.

The above described folding box is fabricated as follows:

Using the blank shown in FIG. 4, the backdrop walls 31, 32, the base strips 35, 36, and the strut 38, which comprise the insert 30, are folded to make a frame and this is folded over and glued to the other broad side wall 12, as shown in FIGS. 1 through 3. The backdrop walls 31, 32 and the strut 38, which stick out crosswise from the side wall 12, are then folded and laid flat against the wide base strip 35. Then, in the standard way, the folding box is folded into a flat case and the longitudinal gluing flap 15 is glued to the inner side of the one broad side wall 11. Folding boxes fabricated in this fashion are stacked in great numbers and sent to the packing plant. There, the folding boxes which have been prepared in this manner can, as needed, be put in a cartoning machine, in which they are arranged, outfitted, and closed in the standard way. To arrange the insert 30 in the intended position, an additional tappet can be disposed in the cartoning machine.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A reclosable folding box of a packing material for packaging elongated articles, said box being formed from a single blank, said box further having parallel first and second broad side walls (11, 12) and two parallel narrow end walls (13, 14) which connect the first and second broad side walls together to comprise a case with free ends, said case having closing flaps (16–19, 21–24) which close the free ends of the case and which are hinged to ends of the first and second broad side walls at the free ends of the case, the box further having an insert portion for carrying elongated articles, the insert portion being secured in the case and folded from a packing material, the insert portion having a first backdrop wall (31) and a second backdrop wall (32) spaced apart from each other and a strut (38) connected between one end of each of said first and second backdrop walls, the first and second backdrop walls extend parallel to the free ends of the case and the strut (38) is parallel with the first and second broad side walls; the first and second backdrop walls (31,32) are glued, respectively, by a first base strip (35) and a second base strip (36) adjoining its respective backdrop wall at the other end of the backdrop wall to the second broad side wall (12); and the strut (38) is disposed at a set distance from the first broad side wall (11), so that a compartment (40) for receipt of a separate insert is defined between the strut (38) and the first broad side wall (11).

2. A folding box according to claim 1, in which both of the first and second backdrop walls (31, 32) have openings (33) aligned with each other that may receive elongated articles.

3. A folding box according to claim 2, in which the openings (33) are disposed in several rows.

4. A folding box according to claim 1, in which a cover flap (25) is additionally hinged to an end of the second broad side wall (12) to which the first base strip (35) is connected, which cover flap (25) is free of the first base strip and is folded and glued to an outer surface of a closing flap (21) hinged to the first broad side wall (11).

5. A folding box according to claim 1, in which said first base strip (35) is integrally connected to one end of said second broad side wall in a region juxtaposed one of the free ends of the case.

6. A folding box according to claim 5, in which a cover flap (25) is additionally hinged to an end of the second broad side wall (12) to which the first base strip (35) is connected, which cover flap (25) is free of the first base strip and is folded and glued to an outer surface of a closing flap (21) hinged to the first broad side wall (11).

7. A folding box according to claim 5, in which both of the first and second backdrop walls (31, 32) have openings (33) aligned with each other that may receive elongated articles.

8. A folding box according to claim 7, in which the openings (33) are disposed in several rows.

9. A folding box according to claim 5, in which said first base strip (35) is hinged to the second broad side wall (12) on an end of the case that defines a content removal opening, and that a closing flap (21) is hinged to an insertion flap (22) on the first broad side wall (11) in a region of the removal opening.

10. A folding box according to claim 9, in which a cover flap (25) is additionally hinged to an end of the second broad side wall (12) to which the first base strip (35) is connected, which cover flap (25) is free of the first base strip and is folded and glued to an outer surface of a closing flap (21) hinged to the first broad side wall (11).

11. A folding box according to claim 9, in which both of the first and second backdrop walls (31, 32) have openings (33) aligned with each other that may receive elongated articles.

12. A folding box according to claim 11, in which the openings (33) are disposed in several rows.

13. A folding box according to claim 9, in which the first base strip (35), which is connected to said second parallel broad side wall (12), is wider than the second base strip (36).

14. A folding box according to claim 13, in which a cover flap (25) is additionally hinged to an end of the second broad side wall (12) to which the first base strip (35) is connected, which cover flap (25) is free of the first base strip and is folded and glued to an outer surface of a closing flap (21) hinged to the first broad side wall (11).

15. A folding box according to claim 13, in which both of the first and second backdrop walls (31, 32) have openings (33) aligned with each other that may receive elongated articles.

16. A folding box according to claim 15, in which the openings (33) are disposed in several rows.

* * * * *